US009926129B2

(12) United States Patent
Ong

(10) Patent No.: US 9,926,129 B2
(45) Date of Patent: Mar. 27, 2018

(54) SINGLE HOLE SINGLE ACTION AEROSOL CAN

(71) Applicant: ORIENTUS INDUSTRY SDN. BHD., Johor (MY)

(72) Inventor: Yoke En Ong, Skudai Johor (MY)

(73) Assignee: ORIENTUS INDUSTRY SDN. BHD., Johor (MY)

( * ) Notice: Subject to any disclaimer, the term of this patent is extended or adjusted under 35 U.S.C. 154(b) by 10 days.

(21) Appl. No.: 15/034,183

(22) PCT Filed: Nov. 4, 2015

(86) PCT No.: PCT/MY2015/000090

§ 371 (c)(1),
(2) Date: May 4, 2016

(87) PCT Pub. No.: WO2016/093691

PCT Pub. Date: Jun. 16, 2016

(65) Prior Publication Data

US 2016/0347535 A1 Dec. 1, 2016

(30) Foreign Application Priority Data

Dec. 10, 2014 (MY) ..... PI 2014703712

(51) Int. Cl.
*B65D 83/32* (2006.01)
*B65D 83/68* (2006.01)
*B65D 83/20* (2006.01)

(52) U.S. Cl.
CPC ..... *B65D 83/682* (2013.01); *B65D 83/20* (2013.01); *B65D 83/32* (2013.01); *B65D 83/687* (2013.01)

(58) Field of Classification Search
CPC ..... B65D 83/20; B65D 83/32; B65D 83/682; B65D 83/687; B65D 83/66
(Continued)

(56) References Cited

U.S. PATENT DOCUMENTS 3,080,094 A 3/1963 Modderno
3,318,484 A * 5/1967 Modderno ..... B65D 83/687 206/221
(Continued)

FOREIGN PATENT DOCUMENTS

EP 2013115 B1 11/2011
JP 8-48380 A 2/1996
(Continued)

OTHER PUBLICATIONS

International Search Report of PCT Patent Application No. PCT/MY2015/000090 dated Mar. 15, 2016.

*Primary Examiner* — Charles P Cheyney
(74) *Attorney, Agent, or Firm* — Idea Intellectual Limited; Margaret A. Burke; Sam T. Yip

(57) ABSTRACT

A single hole single action aerosol can comprises, a can body having a lower portion and an upper portion, a valve housing, an inner sleeve having a suction tube and a plurality of plastic wings arranged around the suction tube, a detachable unit, a dip tube configured to discharge a mixture from the can body. The upper portion of the can body comprises a stem, an outer gasket, an inner gasket, a mounting cup, a spring and a nozzle. The inner sleeve having a chemical A and the can body having a chemical B. Further, the mixture configured to include chemical A and chemical B. Also, the inner sleeve is integrated with the suction tube for mixing the chemical A and chemical B and discharging the mixture from the can body with single action.

6 Claims, 2 Drawing Sheets

(58) Field of Classification Search
USPC .... 222/145.1, 136, 402.1, 389, 129, 94, 197
See application file for complete search history.

(56) References Cited

U.S. PATENT DOCUMENTS

| | | | | | |
|---|---|---|---|---|---|
| 3,592,359 | A * | 7/1971 | Marraffino | B65D 83/66 | 222/145.1 |
| 3,648,899 | A * | 3/1972 | Lukesch | B65D 83/687 | 222/136 |
| 4,779,763 | A * | 10/1988 | Klawitter | B65D 83/687 | 206/219 |
| 5,456,386 | A * | 10/1995 | Jesswein | B65D 83/687 | 222/136 |
| 7,204,392 | B2 | 4/2007 | Kwasny et al. | | |
| 2002/0100769 | A1* | 8/2002 | McKune | B65D 83/687 | 222/129 |

FOREIGN PATENT DOCUMENTS

| | | | |
|---|---|---|---|
| JP | 2004-231190 | A | 8/2004 |
| JP | 2005-145457 | A | 6/2005 |
| WO | 01/30668 | A1 | 5/2001 |

* cited by examiner

SINGLE HOLE SINGLE ACTION AEROSOL CAN

TECHNICAL FIELD

Embodiments of the present invention relate to an aerosol can, and more particularly to a single hole single action aerosol can with built-in inner sleeve integrated with suction pipe for mixing of two-component chemicals and discharging the mixture of chemicals with a single action technology.

BACKGROUND ART

Aerosol spray is a type of dispensing system which creates an aerosol mist of liquid particles. This is used with a can or bottle that contains a liquid under pressure. When the container's valve is opened, the liquid is forced out of a small hole and emerges as an aerosol or mist. As gas expands to drive out the payload, only some propellant evaporates inside the can to maintain an even pressure. Outside the can, the droplets of propellant evaporate rapidly, leaving the payload suspended as very fine particles or droplets.

Typical liquids dispensed in this way are insecticides, deodorants, paints etc. An atomizer is a similar device that is pressurized by a hand-operated pump rather than by stored gas.

Modern aerosol spray products have three major parts: the can, the valve and the actuator or button. The can is most commonly made of steel or aluminum and may be made of two or three pieces of metal combined together. The valve is crimped to the rig of the can and design of the same determines the spray rate. The actuator is depressed by the user to open the valve; a spring closes the valve again when it is released. The shape and size of the nozzle in the actuator controls the spread of the aerosol spray. In other words, one of the most common type of aerosol containers includes a shell made of steel or aluminum, a valve, a "dip tube" which extends from the valve to the liquid product, and a propellant (a liquefied gas) under pressure. The liquid product is generally mixed with the propellant. When the valve is opened, this solution moves up the dip tube and out the valve. The propellant vaporizes as it is released into the atmosphere, dispersing the product in the form of fine particles.

Further, there are mainly two types of aerosol can i.e. one single component aerosol can and two component aerosol can U.S. Pat. No. 7,204,392 discloses one of the advanced aerosol can which comprises of a body blank, a dome to accommodate a valve, an inwardly arched bottom, inner sleeve arranged at a disk, a tappet arranged at the inner sleeve to split-off the inner sleeve and the tappet being able to be actuated through the disk. The inner sleeve is connected via a spring cage with the disk, the spring cage having a spring-mounted release mechanism acting on the tappet. The tappet acting against a cover arranged at the can-side end of the inner sleeve and splitting it off when actuated, with a diaphragm being arranged between the tappet and the release mechanism. The diaphragm seals the inner sleeve at its bottom disk-side end hermetically against the contents of the pressure pack aerosol can. The purpose of this document is to provide absolutely tight unit formed by its inner sleeve against the contents of the pressure pack aerosol can.

Another improved pressurized dispenser for two-component aerosol systems is described in EP2013115B1. The disclosed system comprises of a cylindrical skirt, a valve disposed in a mandrel, a base and an inner sleeve arranged on the base, wherein the inner sleeve is provided with a cylindrical sleeve wall, a closure, a base element and a plunger, which is moveably disposed in the inner sleeve and whose end projects through the base element, and the base element has a guide for the plunger and a retaining portion, which extends through the base of the pressurized dispenser and is fixed to it, wherein the plunger cooperates with an actuation element arranged outside the pressurized container. The inner sleeve has at least one resilient zone for pressure balance between the interior of the dispenser and the sleeve space in the form of a heat sealing film, which has a material reserve in the form of a fold of material or a bulge which permits the heat sealing film to deflect inwardly into the interior of the inner sleeve under the influence of pressure from the exterior. The objective of the disclosed pressurized dispenser is to enable mounting of various parts on the inner sleeve easily and achieve reliable separation of the closure of the inner sleeve.

The single component aerosol can has not been discussed here for sake of brevity.

The aforesaid two-component aerosol cans and the existing single component aerosol cans consist of number of limitations and disadvantages. The traditional single component aerosol cans are not able to mix hardener and resin in a pressurized can and hence have limited performance. Further, the traditional way of using spray gun system or air compressor to mix 2 packs/2 parts/2 components of chemicals is tedious and difficult. In the existing two components aerosol cans the user is required to reverse the aerosol can upside down and press the mandrel at the bottom valve to break through or rupture the membrane of inner sleeve inside the can. Also, it is difficult for the user to determine whether the inner sleeve inside the can is ruptured upon pressing the bottom end and chemical contained within the can is discharged out properly or not. Due to this limitation, the user cannot be sure of obtaining the final result as a two-component product, of which one of the chemical inside the inner sleeve is not discharged properly to mix with other chemical in the can body. Further, the existing products requires direct filling into two different valves on dome and cone respectively.

Accordingly, there remains a need in the prior art to have an improved aerosol can which overcomes the aforesaid problems and shortcomings.

However, there remains a need in the art for an improved aerosol can which provides convenient method for mixing two-component chemicals and discharging the mixture with a one-hole aerosol can. Further, upon discharging of liquid, it simply indicates that the two chemicals inside the inner sleeve and the can body are mixed. Also, the improved aerosol can enables mixing of two packs or two parts or two components of chemicals inside a pressurized can.

DISCLOSURE OF THE INVENTION

Embodiments of the present invention aim to provide a single hole single action aerosol can which is equipped with an inner sleeve with built-in suction tube. The inner sleeve is integrated with the suction tube for mixing and discharging of two-component chemicals with single action. Also, the proposed single hole single action aerosol can enables the user to determine precisely that the two chemicals inside the inner sleeve and the can body are mixed properly. The single hole single action aerosol can is provided with the features of claim 1, however the invention may additionally reside in any combination of features of claim 1.

In accordance with an embodiment of the present invention, the single hole single action aerosol can comprises a can body having a lower portion and an upper portion, a valve housing, an inner sleeve having a suction tube and a plurality of plastic wings arranged around the suction tube. Further, the single hole single action aerosol can comprises a detachable unit and a dip tube configured to discharge a mixture from the can body. The upper portion of the can body comprises a stem, an outer gasket, an inner gasket, a mounting cup, a spring and a nozzle. The inner sleeve having a chemical A and the can body having a chemical B. The mixture is configured to include chemical A and chemical B. Further, the inner sleeve is integrated with the suction tube for mixing the chemical A and chemical B and discharging the mixture from the can body with single action.

In accordance with an embodiment of the present invention, the dip tube is configured to work as a mandrel and ruptures the inner sleeve on actuation by the stem.

In accordance with an embodiment of the present invention, the stem is actuated by the nozzle.

In accordance with an embodiment of the present invention, the nozzle is configured to spray the mixture.

In accordance with an embodiment of the present invention, the mounting cup is configured to fill in pressurized gas by using under cup gas filling method and crimp the valve housing.

In accordance with an embodiment of the present invention, the detachable unit is a part of the inner sleeve.

While the present invention is described herein by way of example using embodiments and illustrative drawings, those skilled in the art will recognize that the invention is not limited to the embodiments of drawing or drawings described, and are not intended to represent the scale of the various components. Further, some components that may form a part of the invention may not be illustrated in certain figures, for ease of illustration, and such omissions do not limit the embodiments outlined in any way. It should be understood that the drawings and detailed description thereto are not intended to limit the invention to the particular form disclosed, but on the contrary, the invention is to cover all modification/s, equivalent/s and alternative/s falling within the scope of the present invention as defined by the appended claim. The headings used herein are for organizational purposes only and are not meant to be used to limit the scope of the description or the claim. As used throughout this description, the word "may" is used in a permissive sense (i.e. meaning having the potential to), rather than the mandatory sense (i.e. meaning must). Further, the words "a" or "an" mean "at least one" unless otherwise mentioned. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Any discussion of documents, acts, materials, devices, articles and the like is included in the specification solely for the purpose of providing a context for the present invention. It is not suggested or represented that any or all of these matters form part of the prior art base or were common general knowledge in the field relevant to the present invention.

In this disclosure, whenever a composition or an element or a group of elements is preceded with the transitional phrase "comprising", it is understood that we also contemplate the same composition, element or group of elements with transitional phrases "consisting of", "consisting", "selected from the group of consisting of, "including", or "is" preceding the recitation of the composition, element or group of elements and vice versa.

DESCRIPTION OF DRAWINGS AND BEST MODE FOR CARRYING OUT OF THE INVENTION

So that the manner in which the above recited features of the present invention can be understood in detail, a more particular description of the invention, briefly summarized above, may be had by reference to embodiments, some of which are illustrated in the appended drawings. It is to be noted, however, that the appended drawing illustrate only typical embodiments of this invention and are therefore not to be considered limiting of its scope, for the invention may admit to other equally effective embodiments.

These and other features, benefits and advantages of the present invention will become apparent by reference to the following text figure, with like reference numbers referring to like structures across the views, wherein.

Figure 1:
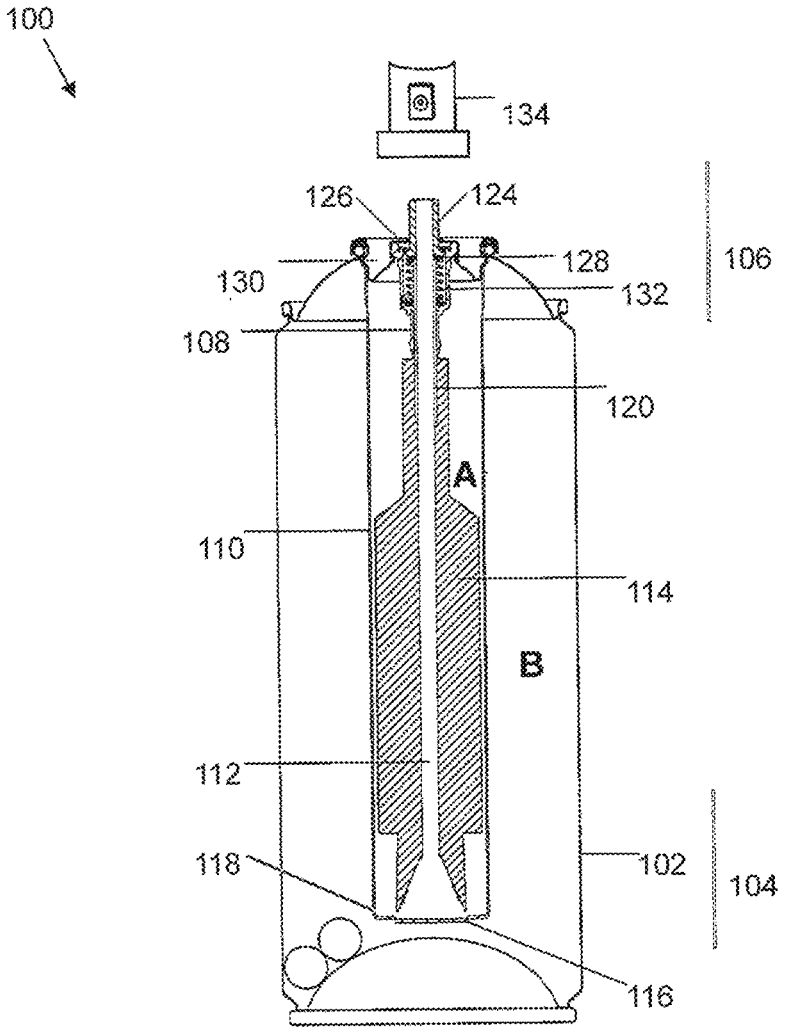
FIG. 1 illustrates a single hole single action aerosol can in accordance with an embodiment of the present invention.

The present invention is described hereinafter by various embodiments with reference to the accompanying drawing, wherein reference numerals used in the accompanying drawing correspond to the like elements throughout the description. This invention may, however, be embodied in many different forms and should not be construed as limited to the embodiment set forth herein. Rather, the embodiment is provided so that this disclosure will be thorough and complete and will fully convey the scope of the invention to those skilled in the art. In the following detailed description, numeric values and ranges are provided for various aspects of the implementations described. These values and ranges are to be treated as examples only, and are not intended to limit the scope of the claims. In addition, a number of materials are identified as suitable for various facets of the implementations. These materials are to be treated as exemplary, and are not intended to limit the scope of the invention.

Embodiments of the present invention aim to provide a single hole single action aerosol can which is equipped with an inner sleeve with built-in suction tube in order to improve the features and quality of aerosol paints. The inner sleeve is integrated with the suction tube for mixing and discharging of two-component chemicals with single action. Also, the proposed single hole single action aerosol can enables the user to determine precisely that the two chemicals inside the inner sleeve and the can body are mixed properly.

Referring to the drawing, the invention will now be described in more detail. In accordance with an embodiment of the present invention, a single hole single action aerosol can (100), as shown in FIG. 1, comprises a can body (102), a valve housing (108), an inner sleeve (110), a detachable unit (116) and a dip tube (120).

The can body (102) having a lower portion (104) and an upper portion (106). Further, the can body (102) is having a shape of, but not limited to, a cylinder and the can body (102) is made up of, but not limited to, a metal or an alloy.

Also, the can body (102) is having a chemical B where the chemical B is, but not limited to, a resin.

The upper portion (106) of the can body (102) comprises a stem (124), an outer gasket (126), an inner gasket (128), a mounting cup (130), a spring (132) and a nozzle (134). The characteristics and functioning of the parts of the upper portion (106) are apparent to a person skilled in the art and therefore have not been described in details for sake of brevity.

The nozzle (134) is configured to spray the mixture and actuate the stem (124).

The inner sleeve (110) includes a suction tube (112) and a plurality of plastic wings (114) arranged around said suction tube (112). Further, the inner sleeve (110) may be fabricated from a suitable material such as, but not limited to, a metal or an alloy or a plastic. Further, the inner sleeve (110) may have a desired shape and configuration in accordance with the structural requirements of the single hole single action aerosol can (100). Also, the inner sleeve (110) is having a chemical A where the chemical A is, but not limited to, a hardener.

The detachable unit (116) is provided at a bottom end (118) of the inner sleeve (110) and located at the lower portion (104) of the can body (102). However, the position of the detachable unit (116) may be positioned within the can body (102) in accordance with the structural requirements of the single hole single action aerosol can (100). Further, the detachable unit (116) is configured to break down from the inner sleeve (110).

The dip tube (120) is configured to discharge a mixture from said can body (102). Further, the dip tube (120) is configured to work as a mandrel and ruptures the inner sleeve (110) on actuation by the stem (124) and the stem (124) is actuated by the nozzle (134). Also, the dip tube (120) is made up of, but not limited to, a metal or an alloy.

In accordance with an embodiment of the present invention, the dip tube (120) may comprises a bending tube as an integrated part of the same. Further, the bending tube is folded within the inner sleeve (110) and configured to discharge all chemicals from the can body (102).

The mounting cup (130) is configured to fill in pressurized gas by using under cup filling method and crimp the valve housing (108).

Figure 2:
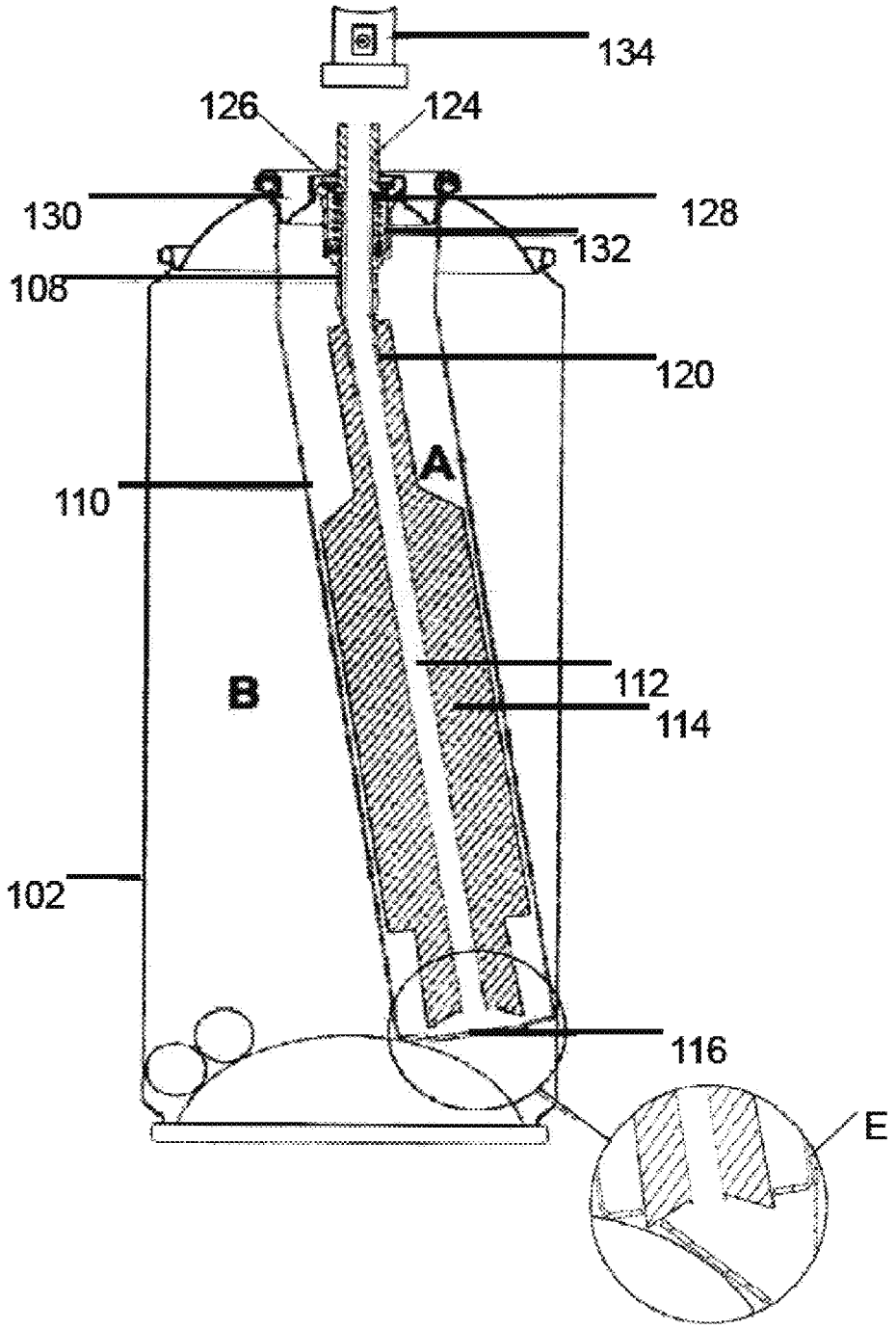
FIG. 2 illustrates functioning of the single hole single action aerosol can of FIG. 1.

FIG. 2 illustrates working of the single hole single action aerosol can (100) of FIG. 1. As shown in FIG. 2, when the nozzle (134) is pressed by a user it actuates the stem (124). Thereafter, the mandrel triggers the inner gasket (128) and moves the detachable unit (116) towards one of the wall of the can body (102). The movement of detachable unit (116) breaks the same (as shown in exploded view E) and releases the chemical A stored within the inner sleeve (110) to the can body (102). Then the user is required to shake, instead of reversing the can upside down, the single hole single action aerosol can (100) in order to mix chemical A and the chemical B stored within the can body (102). Upon mixing, the mixture (A+B) of the chemical A and chemical B is discharged through the suction tube (112) from the single hole single action aerosol can (100). The step of mixing and discharging of the mixture is carried out simultaneously and hence improves the quality of aerosol paint.

The above-mentioned single hole single action aerosol can overcomes the problems and shortcomings of the existing two-component aerosol cans and the single component aerosol cans and provides numerous advantages over them. The proposed single hole single action aerosol can offers high quality and professional result compared to a single component product, for example excellent abrasion resistance, solvents & chemicals resistance, maximum durability etc. Further, the disclosed single action of mixing two-component chemicals and discharging the final mixed chemicals with a one-hole aerosol can provides a simple and more convenient method to the user. It allows user to mix two packs or two parts or two components of chemicals inside a pressurized can. With the said single hole single action, user does not need to reverse the can upside down, but only to press the nozzle of the top valve connecting to the mandrel to break through or rupture the inner sleeve and shake to mix the two components of chemicals (e.g. hardener+resin) inside the can. Also, the disclosed single hole single action aerosol can, upon discharging of mixture, simply indicates that the two chemicals inside the inner sleeve and the can body are mixed.

In addition to the aforesaid advantages of the disclosed single hole single action aerosol can, the proposed single hole single action aerosol can comprises of following key merits/features:

- Reduces cost for processing, manufacturing and job handling.
- Single mixing and discharging through a single hole.
- Inner sleeve with built-in suction tube.
- Uses under cup gas filling method to fill in pressurized gas into the can body.
- Improves the feature/quality of aerosol paint.
- Improves the application of two-component chemicals, method of mixing two-component chemicals become easier compared to use air compressor or spray gun or 2-component 2-hole on dome & cone system.

The exemplary implementation described above is illustrated with specific shapes, dimensions, and other characteristics, but the scope of the invention also includes various other shapes, dimensions, and characteristics. For example, particular shape and size and attachment of the can body with the inner sleeve, plurality of plastic wings, shape of the inner sleeve, and position of the detachable unit. Also, the various attachment and arrangement of the components to the inner sleeve, dip tube, suction tube, mandrel etc. The components as described in the present invention could be manufactured in various other ways and could include various other materials.

Similarly, the exemplary implementations described above include illustration that there would be improve the features and quality of aerosol paints. Further, it also improve the application of two-component chemicals, and there mixing.

Various modifications to these embodiments are apparent to those skilled in the art from the description and the accompanying drawings. The principles associated with the various embodiments described herein may be applied to other embodiments. Therefore, the description is not intended to be limited to the embodiments shown along with the accompanying drawings but is to be providing broadest scope of consistent with the principles and the novel and inventive features disclosed or suggested herein. Accordingly, the invention is anticipated to hold on to all other such alternatives, modifications, and variations that fall within the scope of the present invention and appended claim.

The invention claimed is:

1. A single hole single action aerosol can (100) comprises:

a can body (102) having a lower portion (104) and an upper portion (106);

a valve housing (108);

an inner sleeve (110) having a suction tube (112) and a plurality of wings (114) arranged around said suction tube (112);

a detachable unit (116) provided at a bottom end (118) of said inner sleeve (110) and located at said lower portion (104) of said can body (102);

a dip tube (120) configured to discharge a mixture from said can body (102);

wherein said upper portion (106) of said can body (102) comprises a stem (124), an outer gasket (126), an inner gasket (128), a mounting cup (130), a spring (132) and a nozzle (134);

wherein said inner sleeve (110) having a chemical A and said can body (102) having a chemical B;

wherein said mixture is configured to include chemical A and chemical B;

wherein said inner sleeve (110) is integrated with said suction tube (112) for mixing said chemical A and chemical B and discharging said mixture from said can body (102) with single action;

wherein said plurality of wings (114) extend adjacent to a side of said inner sleeve (110), and each of said plurality of wings (114) extends toward said bottom end (118) of said inner sleeve (110) with a sharp end; and wherein said dip tube (120) and said plurality of wings (114) are configured to work as a mandrel and rupture said inner sleeve (110) on actuation by said stem (124) by moving said detachable unit (116) towards said can body (102) wall to impact said inner sleeve (110) on said can body (102) wall to break said detachable unit (116) from said inner sleeve (110), releasing said chemical A stored within said inner sleeve (110) to said can body (102).

2. The single hole single action aerosol can (100) as claimed in claim 1, wherein said stem (124) is actuated by said nozzle (134).

3. The single hole single action aerosol can (100) as claimed in claim 1, wherein said nozzle (134) is configured to spray said mixture.

4. The single hole single action aerosol can (100) as claimed in claim 1, wherein said mounting cup (130) is configured to fill in pressurized gas and crimp said valve housing (108).

5. The single hole single action aerosol can (100) as claimed in claim 1, wherein said detachable unit (116) is a part of said inner sleeve (110).

6. The single hole single action aerosol can (100) as claimed in claim 1, wherein said plurality of wings are made of plastic.

* * * * *